US006981845B2

(12) United States Patent
Balland et al.

(10) Patent No.: US 6,981,845 B2
(45) Date of Patent: Jan. 3, 2006

(54) BLADE FOR A TURBINE COMPRISING A COOLING AIR DEFLECTOR

(75) Inventors: Morgan Lionel Balland, Paris (FR); Sylvie Coulon, Bois le Roi (FR)

(73) Assignee: Snecma Moteurs, Paris (FR)

( * ) Notice: Subject to any disclaimer, the term of this patent is extended or adjusted under 35 U.S.C. 154(b) by 0 days.

(21) Appl. No.: 10/474,038

(22) PCT Filed: Apr. 17, 2002

(86) PCT No.: PCT/FR02/01325

§ 371 (c)(1),
(2), (4) Date: Oct. 14, 2003

(87) PCT Pub. No.: WO02/086291

PCT Pub. Date: Oct. 31, 2002

(65) Prior Publication Data

US 2004/0115054 A1 Jun. 17, 2004

(30) Foreign Application Priority Data

Apr. 19, 2001 (FR) ..... 01 05289

(51) Int. Cl.
*F01D 5/08* (2006.01)

(52) U.S. Cl. ..... 416/96 R; 416/97 R; 416/248

(58) Field of Classification Search ..... 415/115; 416/97 R, 248, 96 R
See application file for complete search history.

(56) References Cited

U.S. PATENT DOCUMENTS

| | | | | |
|---|---|---|---|---|
| 4,178,129 A | | 12/1979 | Jenkinson | |
| 4,348,157 A | | 9/1982 | Campbell et al. | |
| 4,626,169 A | | 12/1986 | Hsing et al. | |
| 4,820,123 A | * | 4/1989 | Hall | 416/97 R |
| 5,403,156 A | | 4/1995 | Arness et al. | |
| 6,059,529 A | * | 5/2000 | Schiavo | 416/96 R |

FOREIGN PATENT DOCUMENTS

| | | |
|---|---|---|
| DE | 38 35 932 | 4/1990 |
| GB | 1 605 282 | 12/1987 |
| WO | 99 47792 | 9/1999 |

* cited by examiner

*Primary Examiner*—Ninh H. Nguyen
(74) *Attorney, Agent, or Firm*—Oblon, Spivak, McClelland, Maier & Neustadt, P.C.

(57) ABSTRACT

The invention relates to a blade for a turbine, the blade being fitted with a dovetail root to fix it into a compartment of a turbine disk, the blade being fitted with an internal air cooling circuit comprising air inlets located on the blade dovetail root and facing the compartment, and air outlets. The blade dovetail root is fitted with a device capable of homogenising the pressure and temperature of cooling air entering the air inlets.

20 Claims, 3 Drawing Sheets

BLADE FOR A TURBINE COMPRISING A COOLING AIR DEFLECTOR

TECHNICAL DOMAIN

This invention relates to a blade for a turbine, the blade being added onto a disk in the turbine and being cooled by internal air circulation.

STATE OF PRIOR ART

An axial turbine stage is composed of a grid of fixed blades called a distributor and a grid of mobile blades called a wheel. There are single block wheels in which the blades and the disk are all included in the same part. There are also wheels with add-on blades in which the blades and the disk are mechanically assembled together, usually by tripod fittings.

When the wheels operate at high temperature, the blades have to be cooled. This cooling may be done by using air, taken for example from the compressor outlet and routed inside the blades through their attachment to the disk. Cooling air penetrates through the dovetail root of the blade, for example to exit through the opposite end and through one of its faces.

FIG. 1A shows a partial view of a blade 1 mounted on a disk 2, the view being shown in a plane perpendicular to the axis of the turbine. More precisely, it shows the dovetail root 3 of the blade 1 in its position in a compartment 4 of the disk 2. The dovetail root is shown in section along the axis of a channel 5 that brings cooling air from the bottom of the compartment 4 as far as the internal cooling circuit of the blade, not shown. Cooling air circulates in the compartment 4 in a direction perpendicular to the plane of the figure. In the example shown, air is introduced through the end of the compartment corresponding to one face of the disk called the upstream face, and returns into the channel(s) 5, since the other end of the compartment corresponding to the other face of the disk or the downstream face, is closed off.

Cooling air drawn off at the compressor outlet is injected through an end plate held in contact with the upstream face of the disk to make the air circuit leak tight. To achieve this, the end plate is often held in place on the disk by a system of hooks called claws.

The hooks also perform another function. They make the cooling air moving towards the compartments rotate at a speed equal to the rotation speed of the turbine rotor. The cooling air then arrives in front of the compartment turning at the same speed as the compartment and enters into the compartment without any secondary effects.

However, these hooks have the disadvantage that they are expensive and have a relatively short life. Therefore, it would be attractive to be able to eliminate them. However, tests have shown that turbine blades are not cooled as well if these hooks are removed.

Document WO-A-99 47792 divulges a turbine blade, the blade having a dovetail root used to fix it in a compartment of the turbine disk. The blade has an internal air cooling circuit comprising air inlet means located on the dovetail root of the blade and facing the compartment, and air outlet means. The dovetail root of the blade is provided with a device for directing cooling air for the blade. This device also evacuates cooling air after it passes inside the blade. The device separates cooling air circuits entering into the blade and exiting from the blade.

Document GB-A-1 605 282 divulges a blade for a turbine, the blade being provided with a dovetail root through which it is added on into a compartment of a disk in the turbine. The blade has an internal air cooling circuit composed of channels, comprising air inlet means located on the dovetail root of the blade and facing the compartment, and air outlet means located at the end of the blade. The dovetail root of the blade is provided with a cooling tube, through which cooling air is brought in from the intake air collector as far as the air inlets.

Document U.S. Pat. No. 4,348,157 divulges a turbine blade added onto a disk through a dovetail root. The blade is provided with an internal air cooling circuit comprising an air inlet orifice. The air inlet orifice is not located on the dovetail root of the blade facing the housing compartment for this dovetail root, but it is in the connecting part between the dovetail root and the blade, in other words in the leg. Passages are provided to bring the cooling air as far as the blade air inlets. These passages may comprise deflectors.

Document U.S. Pat. No. 4,178,129 divulges a turbine blade cooling system by air circulation. Each blade has a dovetail root used to fix it into a compartment of a turbine disk. The blade is provided with an internal air cooling circuit including air inlet means located on the dovetail root of the blade. The cooling air is sent either into a cooling air supply chamber into which the cooling channels open up, or directly into the leading edge channel through a Pitot receiver.

According to document WO-A-99 47792 mentioned above, the incoming cooling air is brought in through a tube-shaped device communicating with the orifices in the cooling channels. The tube-shaped device may be provided with orifices with a size adapted to the orifices in the channels or orifices almost the same width as the compartment. In both cases, it is impossible to prevent the formation of a vortex.

According to document GB-A-1 605 282 mentioned above, an air cooling tube is provided adapted to the width of the compartment. Therefore, it is impossible to prevent the formation of a vortex.

With reference to document U.S. Pat. No. 4,348,157 mentioned above, air arrives directly on a face in which a hole is drilled, which leads to the same conclusion.

With reference to document U.S. Pat. No. 4,178,129 mentioned above, air arrives either directly in a hole (through a Pitot receiver) or directly on a face in which holes are drilled, which leads to the same conclusion.

SUMMARY OF THE INVENTION

The inventors of this invention discovered the reason for the drop in cooling efficiency when hooks or claws are eliminated, and they have found a solution to this problem.

FIG. 1B illustrates the phenomenon that causes a loss of efficiency in cooling the blades. This figure shows the bottom face of the dovetail root 3 marked reference 6 in FIG. 1A. The channel(s) 5 is (are) not shown. The end plate held in contact with the upstream face of the disk is shown as reference 7. Reference 8 shows a compartment closing off end plate, on the downstream side of the disk.

The inventors reached the conclusion that when air is no longer guided as far as the compartment, cooling air reaches the compartment at a lower rotation speed than when it is guided. Air is then scooped up and rotates in the compartment forming a vortex as shown in FIG. 1B. The centre of this vortex is a very large pressure drop that jeopardises the supply of cooling air to the blade.

This invention provides a means of overcoming this problem whenever it is present in a turbine.

Its purpose is a turbine blade, the blade being provided with a dovetail root used to add it into a compartment of a turbine disk, the blade being provided with an internal air cooling circuit comprising air inlet means located on one face of the dovetail root of the blade in front of said compartment, and air outlet means, characterised in that said face of the dovetail root of the blade is equipped with a deflector comprising at least one fin used to guide the cooling air circulating in the bottom of the compartment to regularise the air flow towards the air inlet means.

The presence of such a deflector on the face of the dovetail root of the blade in which the air inlet means are located provides a means of preventing the formation of a vortex.

The deflector may form an integral part of the blade.

The deflector may be an add-on element on the dovetail root of the blade and may be provided with access means to the air inlet means. The access means may comprise at least one calibrated hole.

The fin may be straight or inclined with respect to the main axis of the blade.

According to one advantageous embodiment, the deflector comprises at least one fin used to guide cooling air entering the compartment and at least one fin that guides discharged air towards the centre of the compartment.

BRIEF DESCRIPTION OF THE DRAWINGS

The invention will be better understood, and other advantages and special features will become clear after reading the following description given as a non-limitative example, accompanied by the attached drawings in which.

DETAILED DESCRIPTION OF EMBODIMENTS OF THE INVENTION

Figure 1A:
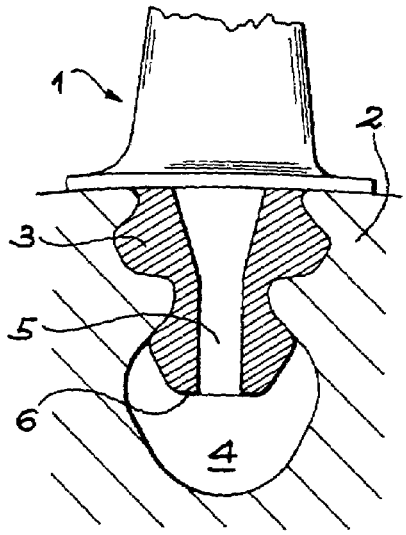
FIG. 1A, already described, is a partial view of a turbine blade mounted on a disk according to prior art, FIG. 1B, already described, is a view of the bottom face of a blade dovetail root for a turbine according to known art.
Figure 2A:
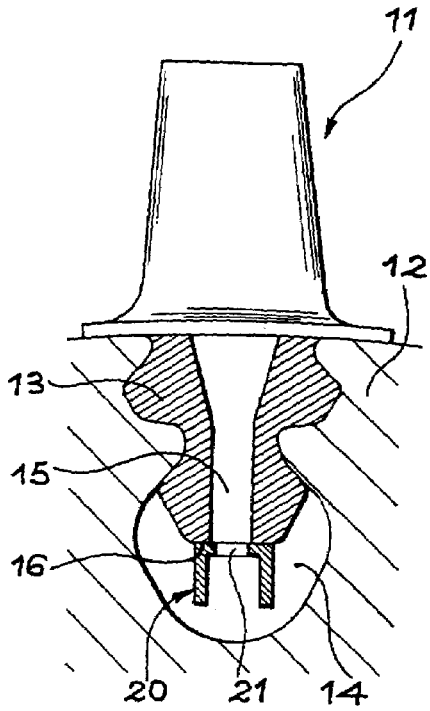
FIG. 2A is a view of a turbine blade installed on a disk, according to the invention.

FIG. 2A shows a view of a blade 11 according to the invention installed on a disk 12, the view being shown in a plane perpendicular to the axis of the turbine as in FIG. 1A. The dovetail root 13 of the blade 11 is in position in a compartment 14 of the disk 12. The dovetail root is shown in a sectional view along the axis of a channel 15 bringing cooling air from the bottom of the compartment 14 as far as the internal cooling circuit of the blade, not shown. Air is circulated in the compartment as described above for FIG. 1A.

Unlike the blade described in figure 1A, the blade in figure 2A is provided with a deflector 20 fitted to the lower face 16 of the blade dovetail root. The deflector 20 comprises fins that direct cooling air circulating in the bottom of the compartment 14. FIG. 2A shows that there is a hole 21 in the deflector in correspondence with the channel 15 and providing access means to the channel for the cooling air. This hole may be a calibrated hole, and is easy to make on a part such as an add-on deflector.

Figure 1B:
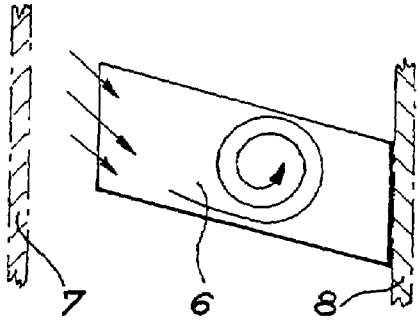
Figure 2B:
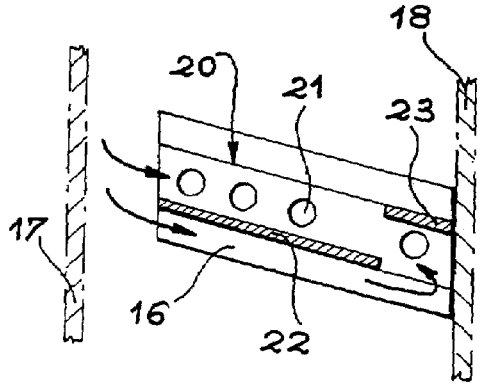
FIG. 2B is a view of the bottom face of a blade dovetail root for a turbine, according to the invention.

FIG. 2B, corresponding to FIG. 1B for prior art, contains arrows showing how cooling air is channelled at the bottom of the compartment between end plates 17 and 18 of the disk 12. In this figure, the deflector is equipped with two fins 22 and 23 located on each side of the line on which the holes 21 are formed. The fins are arranged so as to form a type of baffle. Note also that there are four holes in the deflector shown for the passage of cooling air.

The presence of a deflector on the lower face of the dovetail root of the blade prevents the formation of a vortex and the creation of a pressure drop.

The deflector may be a part added onto the blade dovetail root by welding or brazing. As a variant, the deflector may form an integral part of the blade.

Figure 3:
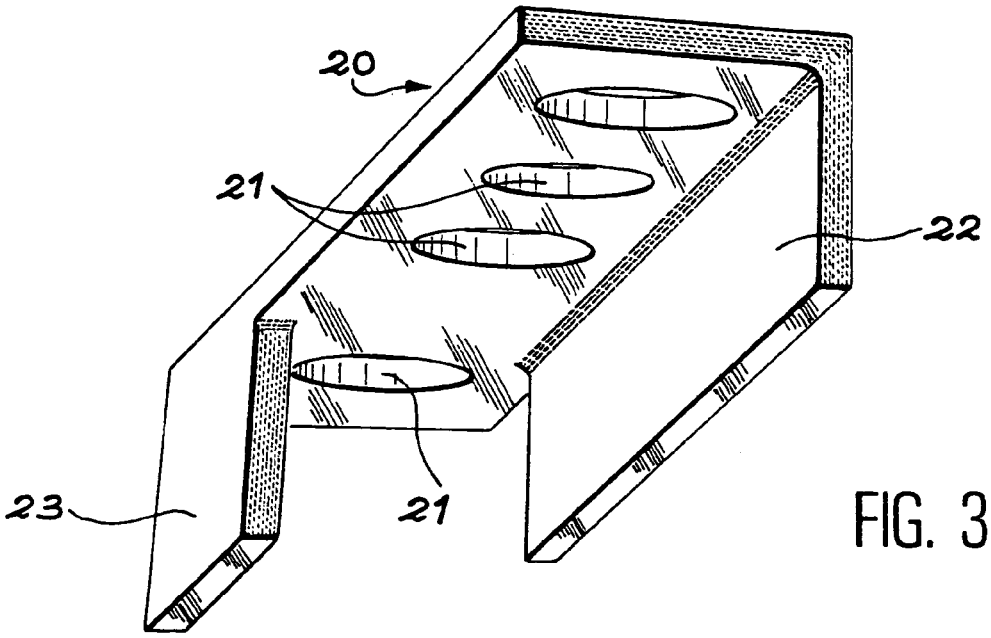
FIG. 3 is a perspective view of a deflector used in this invention.

FIG. 3 shows a perspective view of the deflector 20 mentioned above. This figure provides a better view of the fins 22 and 23 and the holes 21.

Figure 4:
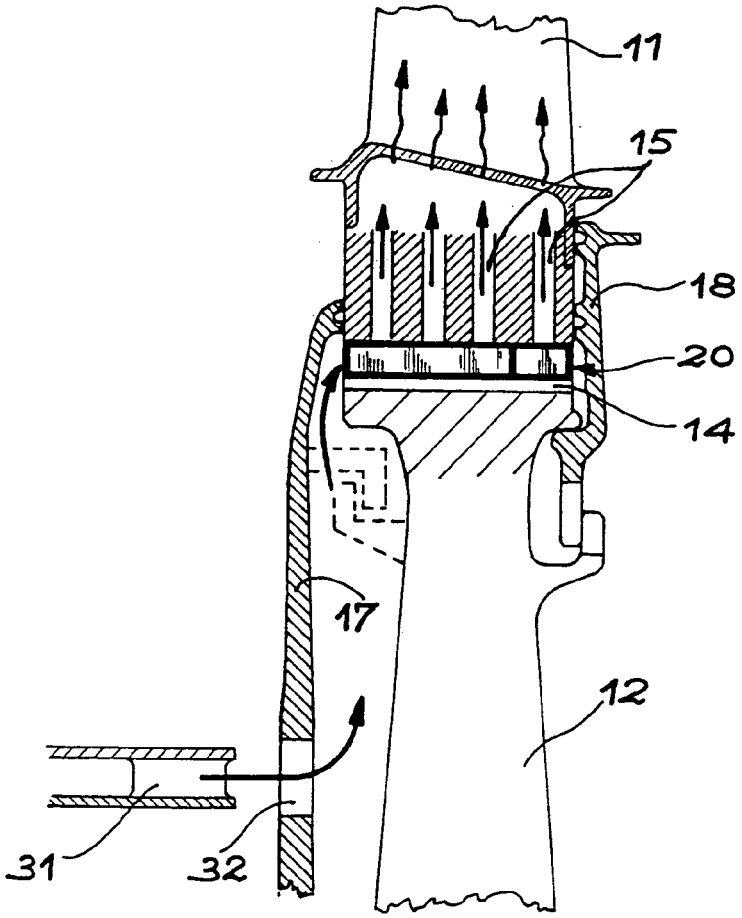
FIG. 4 is a partial sectional view of a turbine in which a blade according to the invention has been fitted.

FIG. 4 is a partial sectional view of a turbine fitted with a blade according to the invention. FIG. 4 shows a blade 11 fitted with a deflector 20 and mounted in a compartment 14 of the disk 12. This figure also shows the end plate 17 held in contact with the upstream side of the disk 12 and the end plate 18 closing off the compartment.

Cooling air is drawn off at the bottom of the chamber and is accelerated through a series of injectors like injector 31. This air then passes through holes, such as hole 32 drilled on the end plate 17, and then moves up towards the bottom of compartments as shown by the arrows in FIG. 4. The hooks or claws that can be eliminated according to the invention are shown in dashed lines.

Figure 5:
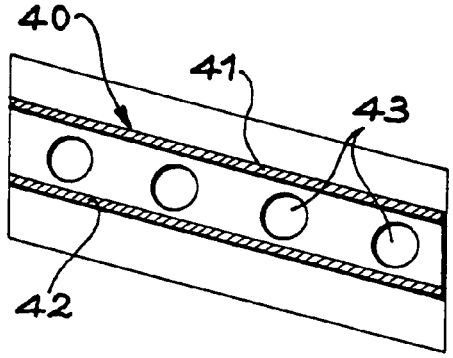
FIGS. 5 and 6 are bottom views of deflectors that can be used by this invention.
Figure 6:
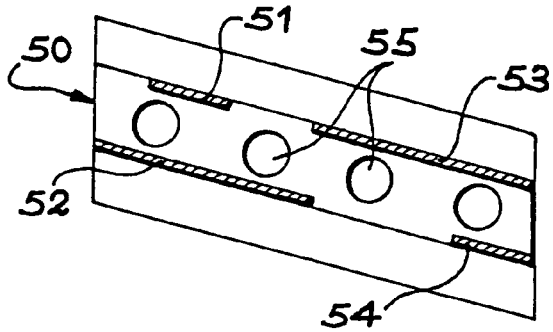

FIGS. 5 and 6 show other shapes of deflectors that can be used by this invention, in position on the lower face of a blade dovetail root.

In FIG. 5, the deflector 40 is provided with two fins 41 and 42 present over the entire length of the deflector. Access holes 43 to blade channels are also shown.

In FIG. 6, the deflector 50 comprises a first series of fins 51 and 53 located on one side of the deflector, and a second series of fins 52 and 54 located on the other side of the deflector. The fins are laid out so as to form baffles. Access holes 55 to blade channels are also shown.

The deflector may also comprise one or several curved fins to guide cooling air along a more variable path.

FIGS. 7 to 10 show examples of other deflector shapes that can be used by this invention. All these views are shown as cross-sections along a cooling air passage hole.

Figure 7:
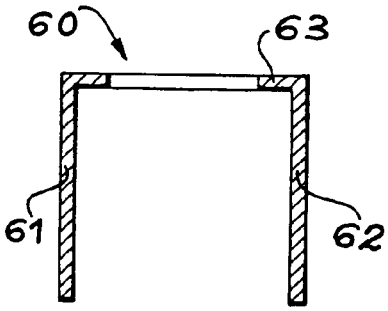
FIGS. 7 to 10 are cross-sectional views of different deflectors that can be used by this invention.

The deflector 60 in FIG. 7 is in the shape of a rail. It comprises fins 61 and 62 arranged at a right angle from the support face 63 of the deflector on the blade dovetail root. The fins 61 and 62 may run along the entire length of the deflector or may be interrupted to form baffles.

Figure 8:
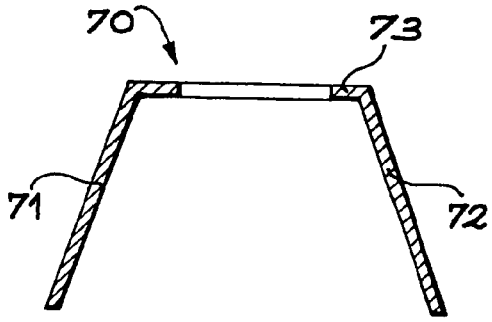
Figure 9:
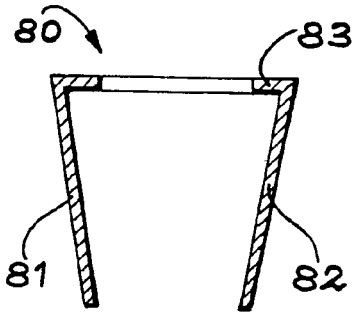
Figure 10:
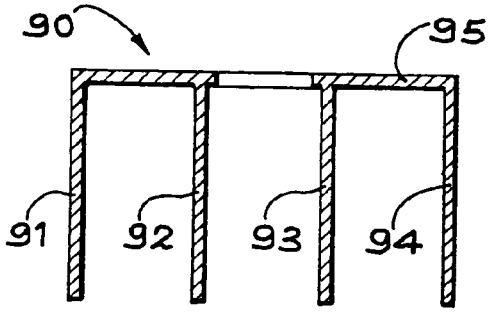

The same is true for deflectors 70, 80 and 90 shown in FIGS. 8, 9 and 10 respectively. The deflector 70 comprises fins 71 and 72 that flare outwards from the deflector support face 73 on the blade dovetail root. The deflector 80 comprises fins 81 and 82 that become closer to each other as the distance increases from the support face 83 of the deflector on the blade dovetail root. The deflector 90 comprises four parallel fins 91, 92, 93 and 94 laid out at a right angle from the support face 95 of the deflector on the blade dovetail root.

The invention provides a static pressure gain at the centre of the compartment to overcome about 75% of the pressure drop that would have occurred without the add-on arrangement. This improved supply of cooling air to the blade reduces the average temperature of the blade depending on operating conditions and consequently extends its life.

What is claimed is:

1. Turbine blade, comprising:

a dovetail root configured to fit the blade into a compartment of a turbine disk;

an internal air cooling circuit including an air inlet located on one face of the dovetail root of the blade in front of the compartment, and an air outlet, said air inlet comprising channels aligned on an alignment axis, in which the face of the dovetail root of the blade is equipped with a deflector including at least one fin located on one side of the alignment axis of the channels.

2. Turbine blade according to claim 1, wherein the deflector forms an integral part of the blade.

3. Turbine blade according to claim 1, wherein the deflector is an add-on element on the dovetail root of the blade and is provided with an access to the air inlet.

4. Turbine blade according to claim 3, wherein the access includes at least one calibrated hole.

5. Turbine blade according to claim 1, wherein the fin is straight or inclined with respect to a main axis of the blade.

6. Turbine blade according to claim 1, wherein the deflector includes at least one fin configured to guide cooling air entering the compartment and at least one fin configured to guide discharged air towards a center of the compartment.

7. Turbine blade according to claim 1, wherein the deflector includes at least one curved fin.

8. The turbine blade according to claim 1, wherein the at least one fin comprises two fins, a first fin being disposed on one side of the alignment axis and the other fin being disposed on the other side of the alignment axis.

9. The turbine blade according to claim 1, where the at least one fin comprises four fins, two of the four fins being disposed on one side of the alignment axis and the other two being disposed on the other side of the alignment axis.

10. Turbine blade, comprising:

a dovetail root configured to fit the blade into a compartment of a turbine disk;

an internal air cooling circuit comprising an air inlet located on one face of the dovetail root of the blade in front of the compartment, and an air outlet, said air inlet comprising channels aligned on an alignment axis, wherein the face of the dovetail root of the blade is equipped with a deflector comprising at least two fins, the fins being located on both sides of the alignment axis of the channels.

11. Turbine blade according to claim 10, wherein the deflector forms an integral part of the blade.

12. Turbine blade according to claim 10, wherein the deflector is an add-on element on the dovetail root of the blade and is provided with an access to the air inlet.

13. Turbine blade according to claim 12, wherein the access includes at least one calibrated hole.

14. Turbine blade according to claim 10, wherein the fin is straight or inclined with respect to a main axis of the blade.

15. Turbine blade according to claim 10, wherein the deflector includes at least one fin configured to guide cooling air entering the compartment and at least one fin configured to guide discharged air towards a center of the compartment.

16. Turbine blade according to claim 10, wherein the deflector includes at least one curved fin.

17. The turbine blade according to claim 10, wherein the at least two fins comprise four fins, two of the four fins being disposed on one side of the alignment axis and the other two being disposed on the other side of the alignment axis.

18. The turbine blade according to claim 10, wherein a first fin of the at least two fins comprises a first series of fins disposed on the same side of the alignment axis, and a second fin of the at least two fins comprises a second series of fins disposed on the other side of the alignment axis.

19. A turbine blade, comprising:

a dovetail root configured to fit the blade into a compartment of a turbine disk;

an internal air cooling circuit comprising an air inlet located on a face of the dovetail root facing the compartment; and means for preventing a formation of a vortex on a cooling air flow flowing from the compartment to the air cooling circuit through the air inlet.

20. The turbine blade according to claim 19, wherein the means for preventing comprises means for preventing the formation of the vortex and recovering a static pressure at a center of the compartment.

* * * * *